US009330897B2

(12) United States Patent
Yagyu

(10) Patent No.: US 9,330,897 B2
(45) Date of Patent: May 3, 2016

(54) MERCURY-FREE DISCHARGE LAMP

(71) Applicant: USHIO DENKI KABUSHIKI KAISHA, Tokyo (JP)

(72) Inventor: Hideaki Yagyu, Himeji (JP)

(73) Assignee: USHIO DENKI KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/721,432

(22) Filed: May 26, 2015

(65) Prior Publication Data

US 2015/0348771 A1 Dec. 3, 2015

(30) Foreign Application Priority Data

Jun. 2, 2014 (JP) ..... 2014-114236

(51) Int. Cl.

| | |
|---|---|
| ***H01J 17/20*** | (2012.01) |
| ***H01J 61/18*** | (2006.01) |
| ***H01J 61/12*** | (2006.01) |
| ***H01J 61/16*** | (2006.01) |
| ***H01J 61/30*** | (2006.01) |
| ***H01J 61/52*** | (2006.01) |
| ***H01J 61/36*** | (2006.01) |

(52) U.S. Cl.

CPC ..... *H01J 61/12* (2013.01); *H01J 61/125* (2013.01); *H01J 61/16* (2013.01); *H01J 61/302* (2013.01); *H01J 61/366* (2013.01); *H01J 61/52* (2013.01)

(58) Field of Classification Search

CPC ..... H01J 61/045; H01J 61/35; H01J 61/523; H01J 61/125; H01J 61/827; H01J 61/18; H01J 61/12; H01J 61/34; H01J 19/42; H01J 17/28

USPC ..... 313/47, 569, 576, 613, 635, 637, 638, 313/643

See application file for complete search history.

(56) References Cited

U.S. PATENT DOCUMENTS 6,639,341 B1 * 10/2003 Sakai ..... H01J 61/125 313/25

FOREIGN PATENT DOCUMENTS

JP H09-293482 A 11/1997

* cited by examiner

*Primary Examiner* — Anne Hines
*Assistant Examiner* — Jose M Diaz
(74) *Attorney, Agent, or Firm* — Studebaker & Brackett PC

(57) ABSTRACT

A mercury-free discharge lamp includes a luminous tube, and a pair of electrodes in the luminous tube such that the electrodes face each other in the luminous tube. The discharge lamp also includes a pair of thermal insulation films formed on an outer surface of the luminous tube around the electrodes, respectively. Zinc, halogen, and a noble gas are sealed in the luminous tube. A metal is also sealed in the luminous tube. The metal has a lower ionization energy than zinc. A ratio of a molar density of the metal to a molar density of zinc is 0.001 to 0.05. The mercury-free discharge lamp has a long life and can emit an ultraviolet beam in a short wavelength range (200-350 nm) at a high output and a high luminous efficacy without causing devitrification of the luminous tube.

9 Claims, 2 Drawing Sheets

FIG. 1
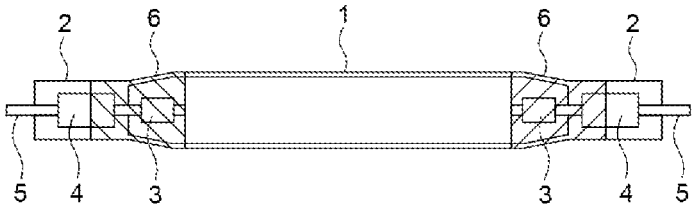
FIG. 2
| Cs/Zn | 0 | 0.001 | 0.005 | 0.01 | 0.05 | 0.1 |
|---|---|---|---|---|---|---|
| 200～300nmUV OUTPUT (arb.unit) | 1 | 0.95 | 0.9 | 0.85 | 0.8 | 0.6 |
| LIGHTING TIME TO REACH MAINTENANCE FACTOR 80% (hr) | 90 | 1200 | 1800 | 2500 | 2700 | 2750 |
| EVALUATION | NG | GOOD | GOOD | GOOD | GOOD | NG |
FIG. 3
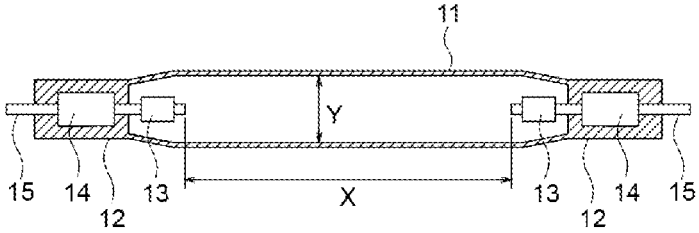

MERCURY-FREE DISCHARGE LAMP

FIELD OF THE INVENTION

The present invention relates to a mercury-free discharge lamp, and more particularly to a mercury-free discharge lamp that has a luminous tube and zinc (Zn) sealedly provided in the luminous tube.

DESCRIPTION OF THE RELATED ART

An ultraviolet discharge lamp is often used for sterilization, disinfection, plastic surface reformation (modification), and a process for curing and drying an ink, paint, adhesive and the like with an ultraviolet beam. The process for curing and drying an ink and the like is sometimes referred to as "UV curing process." In particular, there is a demand for a discharge lamp that can generate a high output (strong luminous intensity) ultraviolet beam in a short wavelength range, i.e., 200-350 nm wavelength range.

One typical example of the discharge lamps that can emit an ultraviolet beam in the above-mentioned short wavelength range is a high-pressure mercury lamp. However, this discharge lamp suffers from a low luminous efficacy. Specifically, the luminous efficacy of this discharge lamp is only several %.

Recently, there is an increasing demand for reducing or eliminating mercury in a lamp in consideration of environment. Thus, no or less use of mercury is a tendency in a lamp industry.

In order to meet such demand, there is proposed a mercury-free discharge lamp that includes zinc (Zn) instead of mercury. Zinc is used as a luminous material in place of mercury, and is sealedly provided in a luminous tube. For example, an example of such mercury-free discharge lamp is disclosed in Japanese Patent Application Laid-Open Publication No. 9-293482 (Patent Literature 1; will be mentioned below). This discharge lamp uses zinc to improve an energy conversion efficiency, and intends to provide a discharge lamp having a high energy conversion efficiency that can be used as a light source for industry use.

FIG. 3 of the accompanying drawings shows the mercury-free discharge lamp of Japanese Patent Application Laid-Open Publication No. 9-293482. As shown in FIG. 3, the discharge lamp has a luminous tube 11, and two electrodes 13 therein. The distance between the two electrodes 13 is represented by "X." The inner diameter of the luminous tube 11 is 2-25 mm, and is represented by "Y." The ratio of the electrode distance X to the luminous tube inner diameter Y (X/Y) is equal to or greater than two. A xenon (Xe) gas and zinc of 0.001-10 mg/cm$^3$ are sealed in the luminous tube 11. The discharge lamp emits light, with a bulb wall load being equal to or greater than 10 W/cm$^2$. Sealing portions 12 outwardly extend from opposite ends of the luminous tube 11, respectively. Inside each of the sealing portions 12, a foil 14 is provided. Each foil 14 has an associated external lead 15 such that the external lead 15 extends outwardly from the foil 14. The electrode 13 extends inwardly from each foil 14.

FIG. 4 of the accompanying drawings shows a luminous intensity (spectral distribution) of the discharge lamp shown in FIG. 3. As shown in FIG. 4, the discharge lamp provides strong light emission in a wavelength range between 200 nm and 220 nm. However, the ultraviolet beam that is most effective for sterilization, disinfection, and UV curing is the light in a wavelength range between 200 nm and 350 nm. If this wide wavelength range is looked at, the discharge lamp of FIG. 3 cannot always provide strong ultraviolet beam, as compared to a medium-pressure mercury lamp.

To deal with it, the inventor extensively studied a method to obtain strong light emission (strong ultraviolet beam) in a wider ultraviolet light range. Then, the inventor found that a spectral distribution significantly changed when heat-retaining films (thermal insulation films) were attached to the outer surface of the luminous tube in the vicinity of the electrodes of the discharge lamp. These films are designed to maintain the temperature of the luminous tube around the electrodes.

FIG. 5 of the accompanying drawings shows another spectral distribution of a similar discharge lamp in comparison to the spectral distribution of FIG. 4. In FIG. 5, the solid line curve indicates when the luminous tube is thermally insulated (i.e., the luminous tube having the thermal insulation films thereon) and the coldest point temperature is raised. The broken line curve indicates when the luminous tube is not thermally insulated. The broken line curve in FIG. 5 is the same as the curve in FIG. 4. When the wavelength range from 200-300 nm is looked at in terms of the integrated value of the emission spectrum, the discharge lamp that has the thermal insulation films thereon has an approximately 30 percent increase in the luminous efficacy as compared to the discharge lamp that has no thermal insulation film. When the temperature of the luminous tube is retained by the thermal insulation films, the inner temperature of the luminous tube is maintained at a high temperature. It is believed that this high temperature facilitates the vaporization of zinc, which is sealed in the luminous tube, and in turn improves the luminous efficacy.

From the foregoing, the inventor found that the mercury-free discharge lamp which had zinc sealed therein could emit an ultraviolet beam at a very high efficacy in the 200-350 nm wavelength range. The inventor also found that the mercury-free discharge lamp which had zinc sealed therein could have a potential gradient that was similar to a potential gradient of a medium-pressure mercury lamp.

However, further experiments and studies revealed that devitrification would occur on the luminous tube before 10-hour lighting operation, when a discharge lamp that had zinc sealed in the luminous tube and the thermal insulation films coated around the luminous tube in the vicinity of the electrodes was used. As a result, the discharge lamp suffered from a significant drop in illuminance.

The inventor studied the reasons for the devitrification of the luminous tube and the decreased illuminance. The inventor found that zinc having a high energy, i.e., zinc ions, collided with the luminous tube, and zinc continuously drove (penetrated) into the wall of the luminous tube. Eventually, in the shallow portion of the luminous tube wall, zinc atoms became saturated. The inventor assumed that the saturated zinc atoms underwent the phase separation in the luminous tube and were condensed. The inventor assumed that this condensation created zinc particles, which in turn blocked (shielded) the light, and as a result, the devitrification of the luminous tube occurred.

Because the vaporization pressure of zinc is greatly dependent on the temperature, the vaporization pressure of zinc changes even if the change in the lamp cooling condition is small. This characteristic of zinc adversely affects the stability of the lamp voltage, and it is difficult to ensure that the discharge lamp provides a stable illuminance.

To deal with the above-described drop in the illuminance, a conventional technique teaches addition of halogen. The inventor confirmed that the addition of halogen prevented the devitrification of the luminous tube in a short time to a certain extent, but also confirmed that the devitrification of the luminous tube took place when the discharge lamp was operated to emit an ultraviolet beam about 100 hours.

In other words, although the addition of halogen extended the life of the discharge lamp to about 100 hours, the amount of halogen added was too small for the discharge lamp to have a practically sufficient life.

Then, the inventor considered the increase of halogen.

As an amount of halogen increases, the devitrification of the luminous tube is suppressed. However, the ultraviolet beam generated in the luminous tube is absorbed by halogen molecules and/or halogen compounds. Thus, the output of ultraviolet beam significantly drops. The inventor concluded that use of halogen could not provide a practically sufficient output of ultraviolet beam.

After all, no conventional approaches can ensure a sufficient output of ultraviolet beam while suppressing the devitrification of the luminous tube.

As described above, the inventor recognized that when a discharge lamp had zinc therein in a sealed manner, and the temperature of the luminous tube near the electrodes was retained to keep the luminous tube temperature to an appropriate value, then the vaporization pressure of zinc was raised and the luminous efficacy in the ultraviolet range was improved. However, the inventor also recognized that because the vaporization pressure of zinc was raised, the zinc ions increased, and the increased zinc ions triggered the devitrification of the luminous tube. In short, a drawback unique to the zinc lamp appeared.

LISTING OF REFERENCES

Patent Literature 1: Japanese Patent Application Laid-open Publication No. 9-293482

SUMMARY OF THE INVENTION

In view of the above-described problems of the conventional techniques, one object of the present invention is to provide a mercury-free discharge lamp that has a long life and can emit an ultraviolet beam in a short wavelength range (200-350 nm) at a high output and a high luminous efficacy without causing devitrification of a luminous tube. The mercury-free discharge lamp includes the luminous tube and a pair of electrodes which face each other in the luminous tube. The discharge lamp also includes thermal insulation films formed on an outer surface of the luminous tube near the electrodes. Zinc, halogen and a noble gas (rare gas) are sealed in the luminous tube.

According to one aspect of the present invention, a metal is sealed in the luminous tube of the discharge lamp, and the metal has a lower ionization energy than zinc. A ratio of the molar density A of the sealed metal to the molar density B of sealed zinc (A/B) is between 0.001 and 0.05 inclusive.

Preferably, the metal is cesium (Cs), rubidium (Rb), potassium (K), sodium (Na), barium (Ba), lithium (Li), cerium (Ce), aluminum (Al), lantern (La), gallium (Ga), thallium (Tl) or indium (In).

The discharge lamp according to one embodiment of the invention contains zinc, halogen and a noble gas in the luminous tube in a sealed manner together with the metal that has a lower ionization energy than zinc. In other words, the metal is additionally included in the luminous tube. Thus, those electrons which are generated upon discharge collide with the metal and produces ions of the metal. The electrons consume the energy when the electrons ionize the metal. Accordingly, the electrons no longer have sufficient energy to ionize zinc. Even when the electrons collide with zinc, the electrons cannot ionize zinc. As a result, it is possible to reduce a total amount of zinc ions, and in turn reduce those zinc ions which drive in (penetrate) the luminous tube wall. This suppresses the devitrification of the luminous tube. In this manner, there is provided a mercury-free discharge lamp that has a long life and can emit an ultraviolet beam in a short wavelength range (200-350 nm) at a high output and a high luminous efficacy.

These and other objects, aspects and advantages of the present invention will become apparent to those skilled in the art from the following detailed description when read and understood in conjunction with the appended claims and drawings.

BRIEF DESCRIPTION OF THE DRAWINGS

FIG. 1 illustrates a cross-sectional view of a mercury-free discharge lamp according to an embodiment of the present invention.

FIG. 2 illustrates results of a life test applied to an exemplary discharge lamp according to an embodiment of the present invention.

FIG. 3 illustrates a cross-sectional view of a conventional discharge lamp. The discharge lamp is not provided with thermal insulation films.

DETAILED DESCRIPTION OF THE INVENTION

Figure 4:
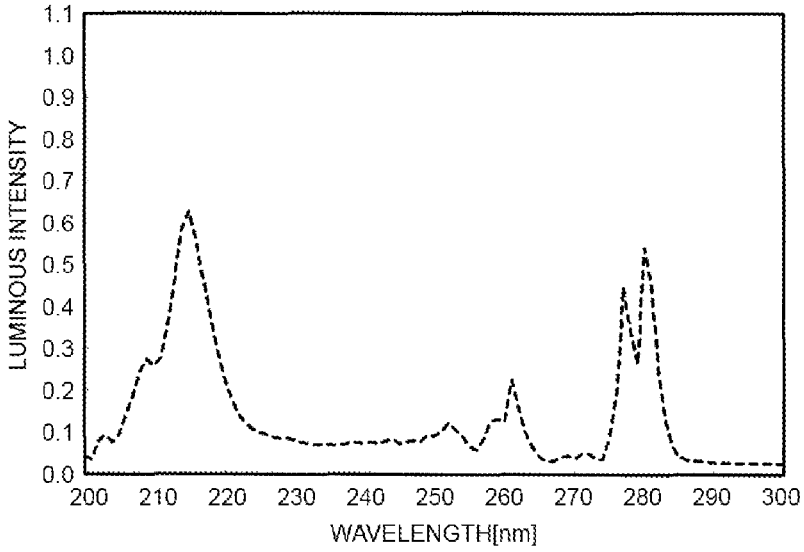
FIG. 4 illustrates an emission spectrum of the discharge lamp shown in FIG. 3.
Figure 5:
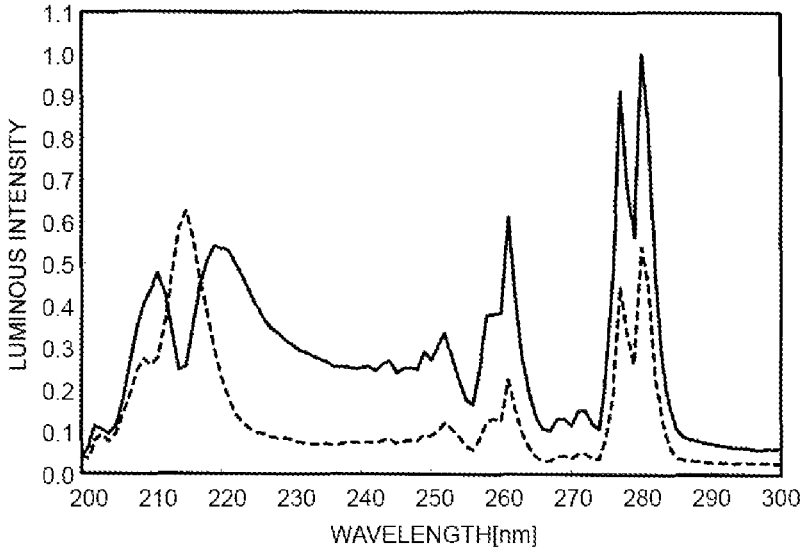
FIG. 5 shows comparison of the emission spectrum between a discharge lamp having thermal insulation films on a luminous tube (solid line curve) and the discharge lamp shown in FIG. 3 (broken line curve).

Referring to FIG. 1, a configuration of a discharge lamp according to an embodiment of the present invention will be described.

The discharge lamp includes a luminous tube 1, which is made from silica glass (quarts glass), and sealing portions 2 at opposite ends of the luminous tube 1. The discharge lamp also includes a pair of electrodes 3 in the luminous tube 1.

In each of the sealing portions 2, a metallic foil 4 is disposed, and the metallic foil 4 is welded to a rear end (outer end) of the associated electrode 3. An external lead 5 is connected to a rear end of each of the metallic foils 4. The external leads 5 extend out of the sealing portions 2.

An outer surface of the luminous tube 1 around each electrode 3 is coated with a thermal insulation film 6.

Zinc (Zn) is sealed in the luminous tube 1. Zinc is a light emission material. Also, halogen and a noble gas are sealed in the luminous tube 1. Cesium (Cs) is also sealed in the luminous tube 1. Cesium serves to reduce or prevent penetration of zinc ions into the wall of the luminous tube 1. Cesium is a metal that has a lower ionization energy than zinc. The noble gas may be a xenon (Xe) gas.

An amount of cesium to be sealed in the luminous tube 1 is calculated (decided) by the following equation:

$$A/B = 0.001 \text{ to } 0.05$$

where A represents a molar density of cesium, and B represents a molar density of zinc.

Preferably, the molar density of zinc (density of zinc atoms) sealed in the luminous tube 1 is increased by raising a vaporization temperature of zinc, in order to cause the zinc atoms to efficiently emit an ultraviolet beam. For this reason, the molar density of zinc is preferably 0.5 to 5 $\mu mol/cm^3$.

If the density of the zinc atoms is smaller than 0.5 $\mu mol/cm^3$, the arc temperature is low. Thus, the vaporization pressure of zinc is low, and it is not possible to obtain sufficient light emission from the zinc atoms.

If the density of the zinc atoms is greater than 5 μmol/cm$^3$, some zinc is left unvaporized. Such zinc shields (blocks) the light, and the illuminance of the discharge lamp drops.

Halogen raises the vaporization pressure of zinc, and obtains a halogen cycle. Halogen is also useful to suppress the penetration of zinc ions into the luminous tube 1. For these reasons, halogen such as iodine or bromine is sealed in the luminous tube 1. The total molar density of halogen sealed in the luminous tube 1 is preferably 0.1 to 2 μmol/cm$^3$.

If the total molar density of halogen sealed in the luminous tube 1 is smaller than 0.1 μmol/cm$^3$, the halogen cycle is not activated and tungsten scatters at an early stage and adheres to the luminous tube 1. The adhered tungsten decreases the light output of the discharge lamp.

If the total molar density of halogen sealed in the luminous tube 1 is greater than 2 μmol/cm$^3$, the light emission significantly drops. Thus, the discharge lamp cannot function as a desired ultraviolet lamp. This is because the halogen molecules or halogen compounds absorb the ultraviolet beam in the short wavelength range.

Cesium is sealed in the luminous tube 1 to suppress (reduce) the penetration of the zinc ions into the luminous tube 1. The assumption of the inventor on the role of cesium in suppressing the zinc ion penetration will be described below.

The ionization energy of zinc is 9.39 eV. When electrons having an energy greater than 9.39 eV collide with zinc, zinc ions are produced.

If a metal (e.g., cesium) having a lower ionization energy than zinc is added, the electrons also collide with cesium and produce cesium ions. The electrons consume the energy to ionize cesium, and therefore no longer has an energy sufficient to ionize zinc. Thus, even if the electrons collide with zinc, the electrons cannot ionize zinc.

Also, the cesium ions have a low energy and therefore they do not penetrate into the wall of the luminous tube 1.

As described above, cesium is provided to primarily suppress the ionization of zinc, but cesium can also demonstrate a secondary function (associated function) because the excitation energy of cesium is low. The secondary function is that the arc temperature distribution in the radial direction of the luminous tube 1 is caused to decrease, and strong lifting of the arc, which is unique to the zinc lamp, is suppressed.

Other examples of the metal than cesium (Cc), which has a lower ionization energy than zinc, include rubidium (Rb), potassium (K), sodium (Na), barium (Ba), lithium (Li), cerium (Ce), aluminum (Al), lantern (La), gallium (Ga), thallium (Tl) and indium (In). Use of any of these elements can provide a similar result to cesium.

When the molar density of the metal having a lower ionization energy than zinc is represented by A and the molar density of zinc is represented by B, then an acceptable ratio of A to B (A/B) may be decided based on evaluation of an illuminance maintenance factor.

In order to evaluate the illuminance maintenance factor (percentage) of the discharge lamp, the inventor prepared a mercury-free discharge lamp that had the electrodes 3 spaced from each other by 200 mm. This distance between the two electrodes 3 is the luminous length. The inner diameter of the luminous tube 1 was 16 mm. The thermal insulation film 6 of the luminous tube 1 around each of the electrodes 3 was a ceramic-based heat insulation film. The outer surface of the luminous tube 1 was coated with the two heat retaining films around the two electrodes 3.

In the luminous tube 1, zinc was sealed at the molar density of 2 μmol/cc, iodine was sealed at the molar density of 0.6 μmol/cc, and 20 kPa of xenon was sealed. Cesium (Cs) was employed as the metal having a lower ionization energy than zinc, and the molar density of cesium was altered to evaluate the illuminance maintenance factor of the mercury-free discharge lamp. In this manner, a plurality of discharge lamps were prepared, which have different molar densities of cesium.

Each of the prepared discharge lamps was lit with the electricity input per 1 cm of arc length being 100 W. The time for the illuminance maintenance factor to become 80%, with the wavelength being 200-300 nm, was measured. The results of the measurement are shown in the table of FIG. 2.

As shown in FIG. 2, when the ratio A/B (i.e., the ratio of Cs to Zn) is equal to or greater than 0.001, the time for the illuminance maintenance factor to become 80% is equal to or greater than 1200 hours. In these examples, the effectiveness of cesium was confirmed. However, when the ratio A/B (Cs/Zn) reaches 0.1, the relative illuminance becomes 0.6. The relative illuminance is a value relative to the illuminance of when no cesium is included (i.e., when the ratio A/B is zero). The illuminance of when no cesium is included is one. Therefore, it is not possible to obtain a sufficient illuminance in an intended process when the ratio A/B is 0.1.

The inventor assumes that if the ratio A/B is smaller than 0.01, the amount of cesium is too small to suppress the penetration of zinc ions into the luminous tube wall. This results in the devitrification of the luminous tube. If the ratio A/B is greater than 0.05, the amount of cesium is too large, and the ultraviolet beam is absorbed by cesium. Thus, the emission output of the discharge lamp decreases.

From the foregoing, it was found that the ratio A/B was preferably 0.001 to 0.05.

As described above, the present invention is directed to a mercury-free discharge lamp that contains zinc, halogen and a noble gas sealed in the luminous tube. A metal having a lower ionization energy than zinc is also sealed in the luminous tube. Thus, electrons generated upon discharge in the luminous tube collide with cesium in the luminous tube so that cesium ions are generated. The electrons spend the energy upon collision with cesium, and do not have an energy to ionize zinc. Accordingly, the electrons cannot ionize zinc even when the electrons collide with zinc.

Therefore, it is possible to suppress the penetration of zinc ions into the luminous tube wall, and in turn suppress the devitrification of the luminous tube. In this manner, the mercury-free discharge lamp of the present invention can have a long life and can emit an ultraviolet beam in a short wavelength range (200-350 nm) at a high output and a high luminous efficacy.

Because the ratio of the molar density of the metal sealed in the luminous tube 1 to the molar density of zinc sealed in the luminous tube 1 (A/B) is set to between 0.001 and 0.05 inclusive, the illuminance maintenance factor is maintained constant for a long time, and the illuminance output is maintained high.

While a certain embodiment has been described, the embodiment has been presented by way of example only, and does not intend to limit the scope of the present invention. The novel apparatus (device) and method thereof described herein may be embodied in a variety of other forms; furthermore, various omissions, substitutions and changes in the form of the apparatus (device) and method thereof described herein may be made without departing from the gist of the present invention. The accompanying claims and their equivalents are intended to cover such forms or modifications as would fall within the scope and gist of the present invention.

The present application is based upon and claims the benefit of a priority from Japanese Patent Application No. 2014-114236, filed Jun. 2, 2014, and the entire contents of which are incorporated herein by reference.

What is claimed is:

1. A mercury-free discharge lamp comprising:

a luminous tube;

a pair of electrodes in the luminous tube such that the pair of electrodes face each other in the luminous tube;

a pair of thermal insulation films formed on an outer surface of the luminous tube around the pair of electrodes, respectively;

zinc sealed in the luminous tube;

halogen sealed in the luminous tube;

a noble gas sealed in the luminous tube; and a metal sealed in the luminous tube, the metal having a lower ionization energy than zinc, a ratio of a molar density of the metal to a molar density of zinc being 0.001 to 0.05.

2. The mercury-free discharge lamp according to claim 1, wherein the metal is cesium (Cs), rubidium (Rb), potassium (K), sodium (Na), barium (Ba), lithium (Li), cerium (Ce), aluminum (Al), lantern (La), gallium (Ga), thallium (Tl) or indium (In).

3. The mercury-free discharge lamp according to claim 1, wherein the luminous tube is made from silica glass.

4. The mercury-free discharge lamp according to claim 1, wherein a molar density of zinc in the luminous tube is 0.5 to 5 $\mu mol/cm^3$.

5. The mercury-free discharge lamp according to claim 1, wherein a molar density of halogen sealed in the luminous tube is 0.1 to 2 $\mu mol/cm^3$.

6. The mercury-free discharge lamp according to claim 1, wherein the discharge lamp emits an ultraviolet beam in a 200 to 350 nm wavelength range.

7. The mercury-free discharge lamp according to claim 1, wherein the halogen includes iodine and/or bromine.

8. The mercury-free discharge lamp according to claim 1, wherein the pair of thermal insulation films are ceramic-based thermal insulation films.

9. The mercury-free discharge lamp according to claim 1, wherein the noble gas is a xenon gas.

* * * * *